United States Patent [19]

Vittone et al.

[11] Patent Number: 5,035,642

[45] Date of Patent: Jul. 30, 1991

[54] AUTOMATICALLY-CONNECTING ELECTRICAL CONNECTOR

[75] Inventors: Oreste Vittone, Moncalieri; Matteo Picciriello, Torino, both of Italy

[73] Assignee: Fiat Auto S.p.A., Torino, Italy

[21] Appl. No.: 518,612

[22] Filed: May 3, 1990

[30] Foreign Application Priority Data

May 3, 1990 [IT] Italy ..... 6731 A/89

[51] Int. Cl.[5] ..... H01R 13/627

[52] U.S. Cl. ..... 439/350; 439/345; 439/353

[58] Field of Search ..... 439/350, 352, 353, 354, 439/355, 357, 358, 345

[56] References Cited

U.S. PATENT DOCUMENTS 4,113,179 9/1978 McKee ..... 439/354
4,669,797 6/1987 Bourdon ..... 439/353
4,900,263 2/1990 Manassero et al. ..... 439/358
4,906,197 3/1990 Noll ..... 439/364 X

FOREIGN PATENT DOCUMENTS 2130445 5/1984 United Kingdom ..... 439/350

*Primary Examiner*—Larry I. Schwartz
*Assistant Examiner*—Julie R. Daulton
*Attorney, Agent, or Firm*—Sughrue, Mion, Zinn, Macpeak & Seas

[57] ABSTRACT

A device for connecting multiway connectors to each other or to electrical equipment enables elastic energy to be stored during the first part of its connecting travel and to be returned during the second part as a force pulling the device to its travel-limit position thus enabling the automatic complete connection of the connectors and reliable electrical contact to be achieved automatically.

7 Claims, 8 Drawing Sheets

FIG. 7 (a)
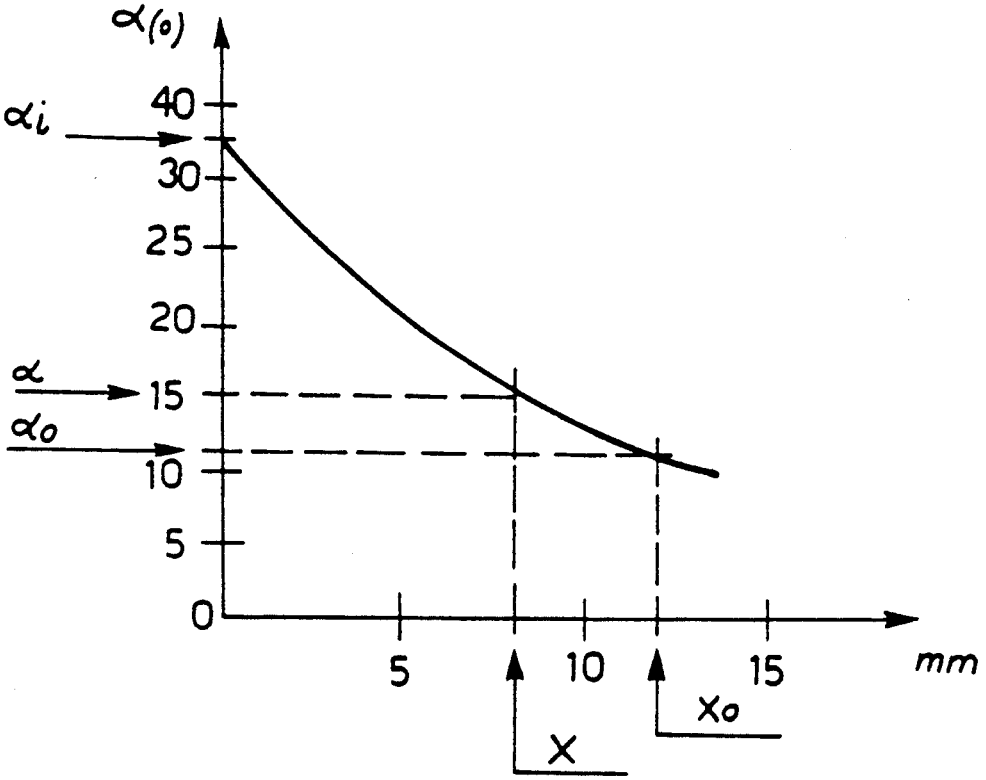
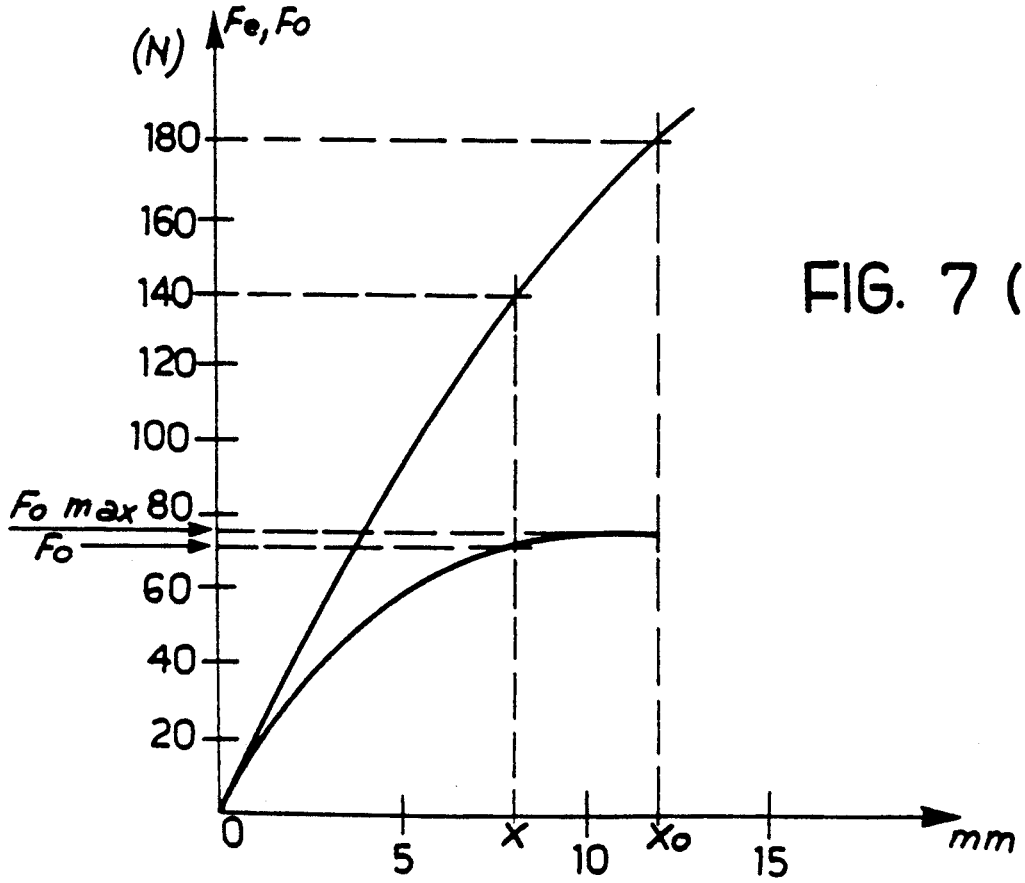
FIG. 7 (b)

AUTOMATICALLY-CONNECTING ELECTRICAL CONNECTOR

BACKGROUND OF THE INVENTION

The invention relates to an electrical connector for multiway connections in the electrical system of a motor vehicle.

Electrical connections between the battery and electrical accessories of a motor vehicle are made by means of male/female electrical terminals (also called "pins") carried by multiway connectors (also commonly known as blocks).

This facilitates electrical connection at the assembly stage and enables the electrical equipment of a motor vehicle to be maintained and replaced during the vehicle's lifetime.

The connection normally consists of two complementary half-connectors (male and female) which are joined together.

The problem inherent in connections of this type is the possibility that, during assembly, the operator may interconnect the two half-connectors only partially (not fully); this partial connection naturally does not show up during testing since it is able to transmit current temporarily but may cause the half-connectors to come apart later, during use of the vehicle, because of vibrations, with the consequent disconnection of the services dependent on the connectors concerned.

It has also been proposed (British patent application No. 2 169 758) to provide one half-connector with resiliently-deformable elements in order to increase the force needed for the insertion of the half-connector up to an intermediate point, called the "dead point", so as then to make use of the resulting impulse to reach the travel limit.

Even this type of connector has some disadvantages, however, again due to the possibility of only partial connection during assembly.

SUMMARY OF THE INVENTION

The present invention proposes to solve the problems mentioned above so as to provide an electrical connector which is reliable, strong, cheap and easy to handle. The objects are achieved, according to the invention, by an electrical connector comprising a first half-connector carrying male or female terminals of a first ribbon of cables and a second half-connector carrying female of male terminals of a second ribbon of cables, one of said half-connectors including a resilient device which stores energy during a first stage in connecting said half-connectors and which can return the stored energy to enable automatic connection of the first and second half-connectors during a subsequent second stage in connecting said half-connectors, said resilient device for restoring energy comprising a substantially U-shaped spring having a pair of diverging free ends in the unstressed state, securing means in the first half-connector engaging the spring and securing said spring in said first half-connector with said spring disposed symmetrically with respect to a longitudinal axis of the connector, said second half-connector having a pair of spaced apart walls with oppositely inclined surfaces which are each inclined at an angle $\beta$ to the longitudinal axis of the connector, said walls having spaced apart free corners where the walls are closest which cause elastic deformation of the U-shaped spring as the spring passes between the corners during connecting of said half-connectors until said free ends of said spring pass the spaced apart corners of said walls, whereby engagement of said free ends of said spring with said inclined surfaces allows said spring to be restored toward said unstressed state and to generate a force to complete inserting said first half-connector into said second half-connector.

The dependent claims give some advantageous solutions of the electrical connector according to the invention.

BRIEF DESCRIPTION OF THE DRAWINGS

Further advantages and characteristics of the will become clear with reference to the appended drawings, in which:

FIGS. 7*a* and 7*b* indicate quantitive changes in some quantities which come into play during the connection;

DETAILED DESCRIPTION OF THE INVENTION

Figure 1:
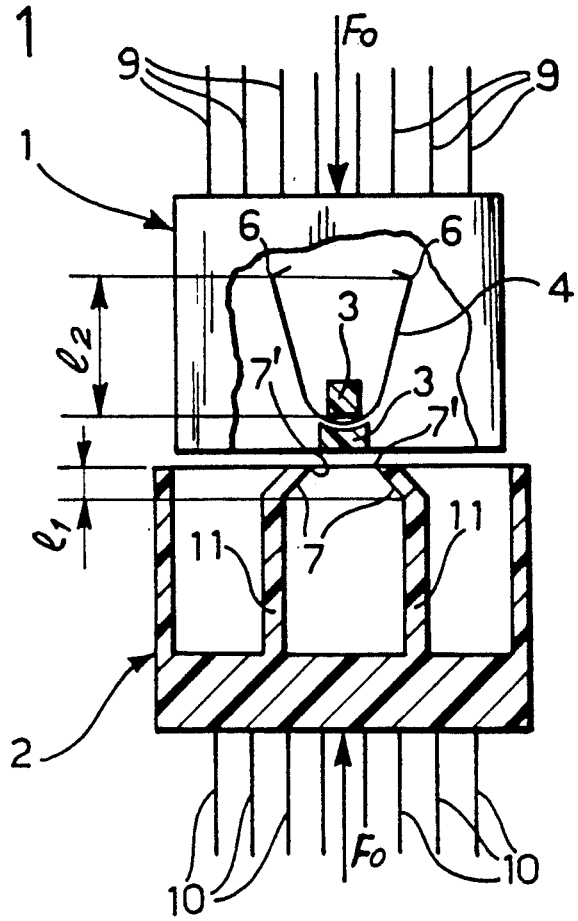
FIGS. 1 to 4 show the electrical connector according to the invention during the stages of connection of two half-connectors.

The embodiment of the electrical connectors according to the invention relates to the mechanical and electrical connection of two separate ribbons of cables 9 and 10 but the invention is also suitable for a case in which a half-connector, such as 1, is to be inserted in a corresponding seat in electrical equipment carrying electrical connections.

The electrical connector according to the invention consists of a first half-connector 1 carrying within it male/female electrical cable terminals, also called pins (not shown in the drawings), of a ribbon of cables 9 and a second half-connector carrying within it male/female electrical cable terminals, also called pins, of another ribbon of cables 10. A U-shaped spring 4 having a pair of diverging free ends in the unstressed state is fixed at 3 in the half-connector 1 with the axis of symmetry of the "U" coincident with the longitudinal axis of the connector according to the invention.

Figure 2:
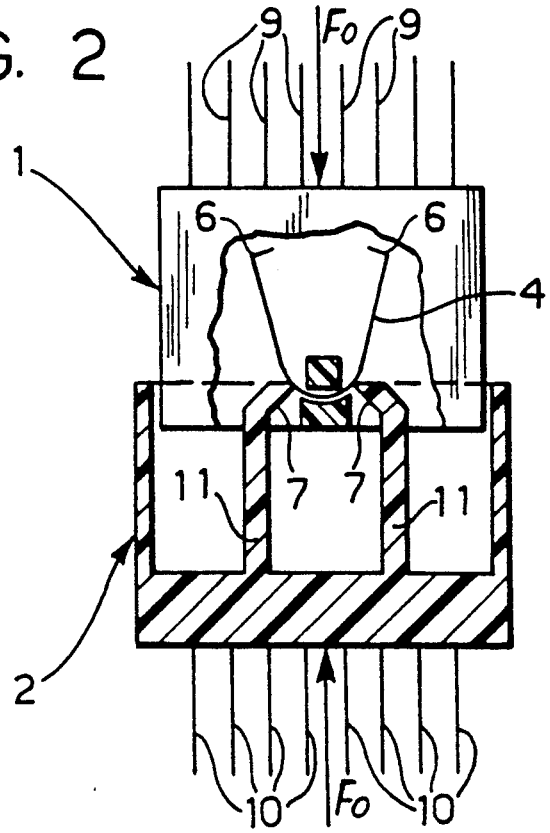

In correspondence with the position in which the spring 4 will be situated after connection, the half-connector 2 has walls 11 with inclined surfaces 7. The insertion of the half-connector 1 into the half-connector 2 is achieved in the following manner: the two half-connectors 1 and 2 are placed face to face with the spring 4 and the wall 11 in contact with each other; at this stage, the force Fo (the force exerted on the half-connectors by the operator) is zero (FIGS. 1 and 2).

Figure 3:
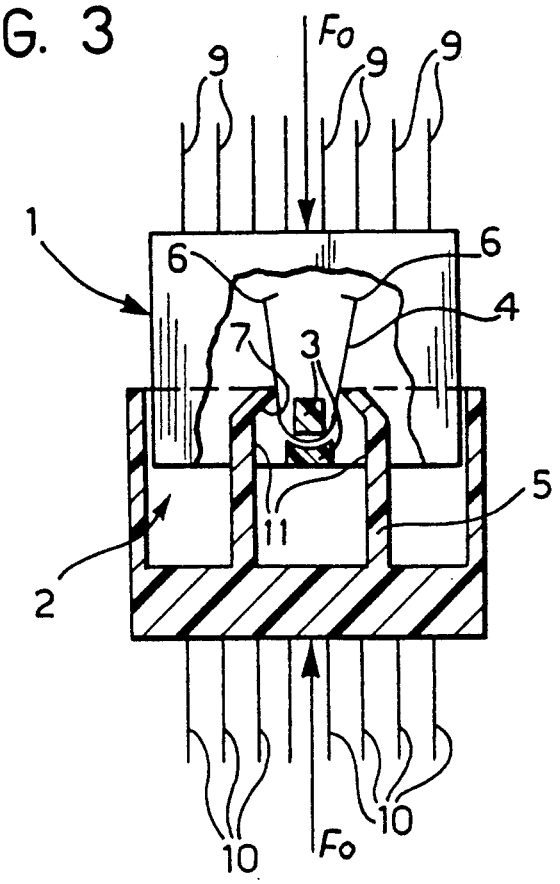

As the insertion travel is continued (FIG. 3), the force Fo increases in value because of the loading of the spring 4 until the two arms 6 of the latter reach the "dead point", that is they come into contact with the corners 7' of the walls 11; in this position, the spring 4 has stored all the elastic energy and the operator has exerted the maximum force Fo.

Electrical contact between the pins of the half-connectors 1 and 2 has not yet been achieved at this moment; it occurs only after the "dead point".

As soon as the "dead point" is reached, the half-connector 1 is pulled into the half-connector 2 by the elastic force stored in the spring 4 whose arms 6 act on the inclined planes 7 which are arranged so as to pull the two half-connectors 1 and 2 towards each other.

During this travel, in order to keep the two half-connectors 1 and 2 in equilibrium, it would be necessary to reverse the force Fo exerted from outside.

The spring 4 therefore develops a force Fr, a pulling force, which ensures the complete and automatic connection of the two half-connectors 1 and 2, that is without any force on the part of the operator, enabling the connection of the male/female pins of the block and also overcoming the resulting friction.

When they have reached their travel limit, the two half-connectors are connected permanently by a positive engagement (not shown in the drawings) which can be released in known manner so that the two half-connectors 1 and 2 can be separated and the two ribbons of cables 9 and 10 disconnected.

If friction is left out of consideration, the force Fo depends on the angle of the spring 4 as well as on its geometry and resilient characteristics, the angle meaning, more precisely, that which is formed between the longitudinal axis of the connector and the tangents to the two arms of the spring 4 at their points of contact with the corners 7' of the walls 11; this angle varies during the connection travel from an initial maximum to a minimum when the "dead point" is reached and then increases again during the "pulling".

The force Fr depends on the orientation of the inclined surfaces 7 of the walls 11 and on the elastic force stored in the spring 4.

It should be noted that the U-shape of the spring 4 is only an example, since it is possible to think of other configurations with any other type of resilient device for storing the energy obtainable during the first stage of the connection travel. For example, a helical spring could be inserted between the two arms 6 of the spring 4, perpendicular to the longitudinal axis of the connector, for storing elastic energy. In this case the two arms of the "V"-shaped device could be rigid and hinged at the vertex of the "V".

The resilient element of the engagement system may be the spring 4 alone, as indicated in the drawings, or the walls 11 may be resilient so as to absorb energy, the U-shaped device being rigid. It is even possible to combine the two extreme cases, that is a spring 4 and walls 11 which are both resilient so as to absorb energy.

Figure 4:
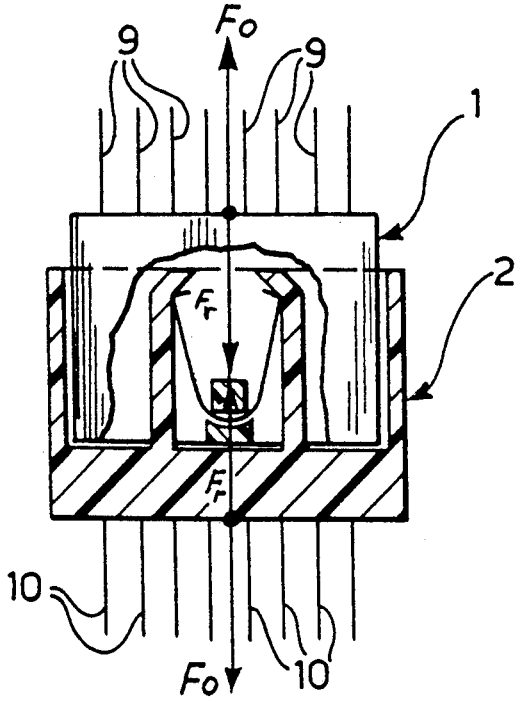

As stated, the electrical contact takes place only after the "dead point", thus ensuring that it is impossible for the operator to connect the two half-connectors 1 and 2 only partially. In fact, (once the operator is no longer exerting the force Fo (FIG. 2)), the two half-connectors are either completely connected (FIG. 4) or they are disconnected so that, even in the event of a connection not being achieved, this anomaly is immediately shown up and corrected upon testing.

With reference to FIGS. 5 to 10, the changes in the forces which come into play will now be explained. The graphs have been determined with the sliding friction between the contact surfaces of the spring 4 and the walls 11 being ignored for simplicity of explanation. Naturally, the friction, which is present in reality, will be such as to require the operator to exert a greater force Fo to achieve the same elastic deformation as in the case of zero friction. Similarly, when the "pulling" force comes into play, the force available for the connection of the electrical pins will be less, for a given elastic deformation of the spring 4, because of the friction.

Figure 5:
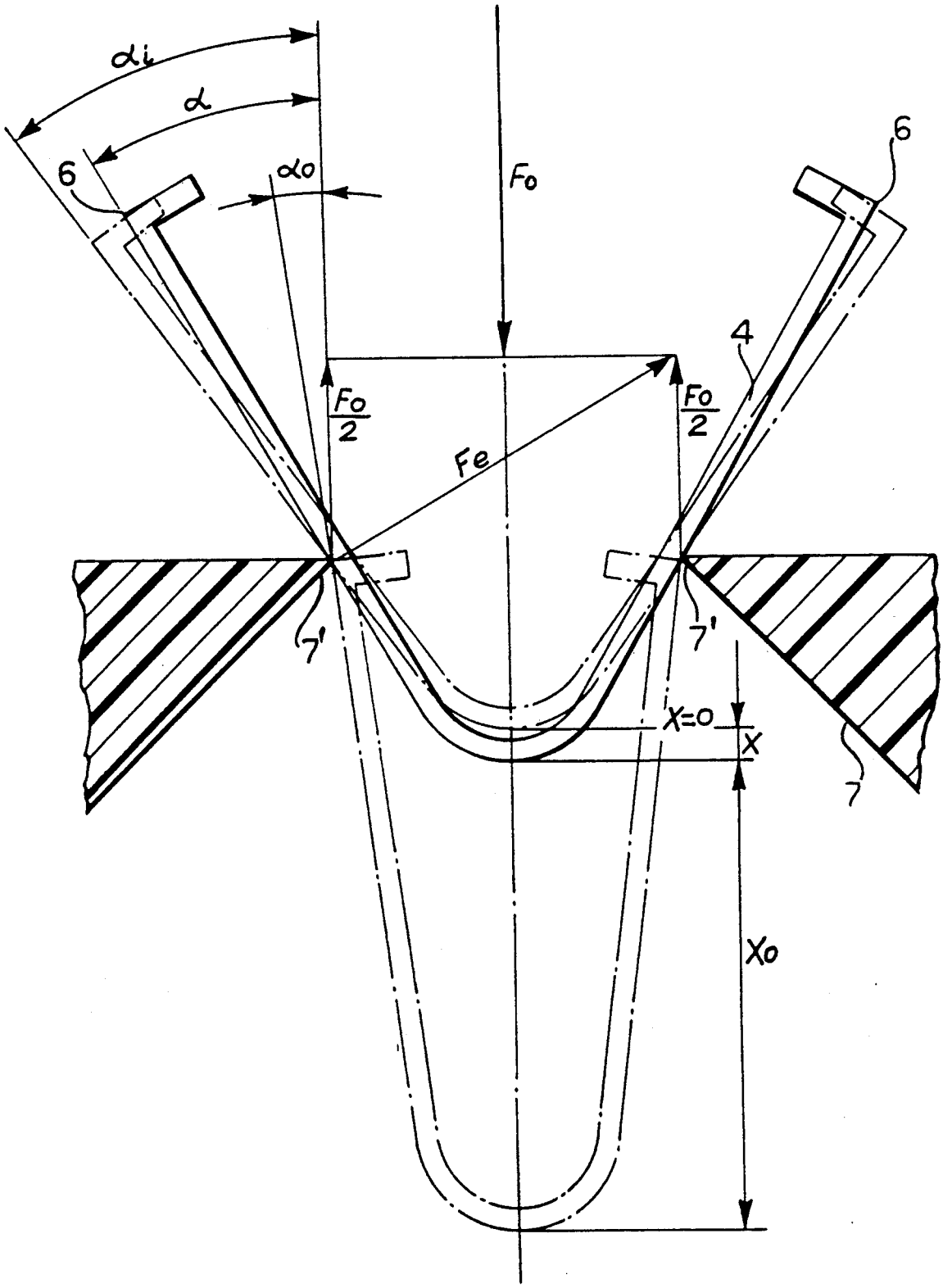
FIG. 5 shows the elastic-energy-storage device of the connector according to the invention.
Figure 6:
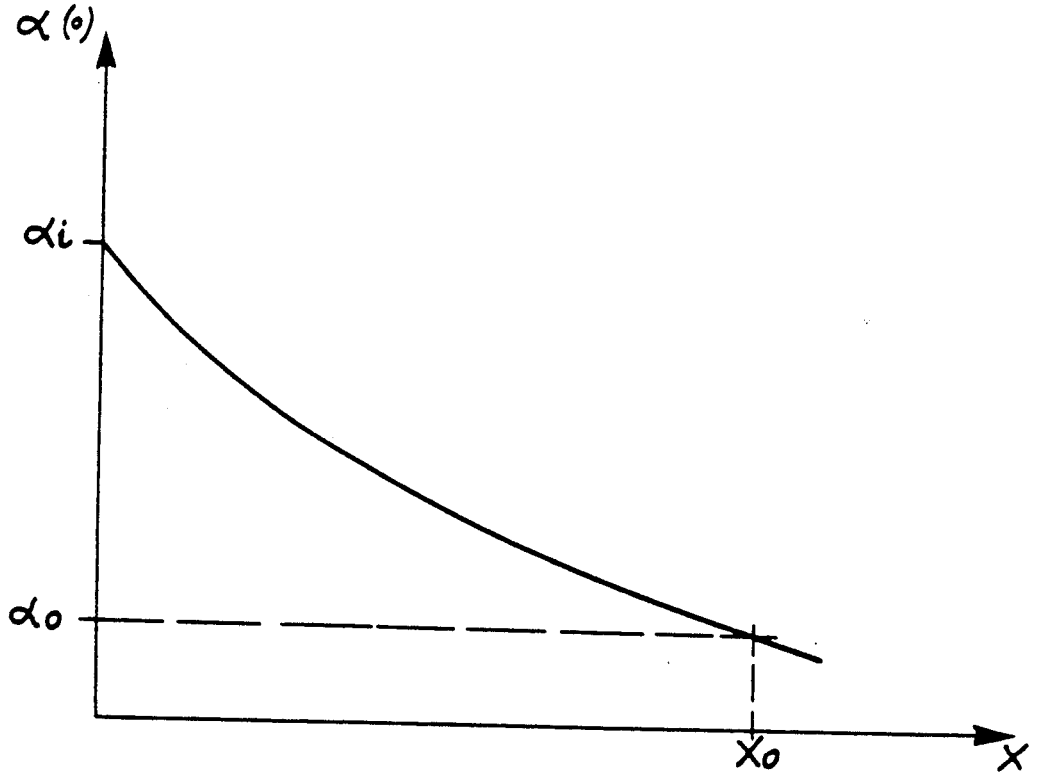
FIGS. 6*a* and 6*b* indicate qualitative changes in some quantities which come into play during the connection.
Figure 6:
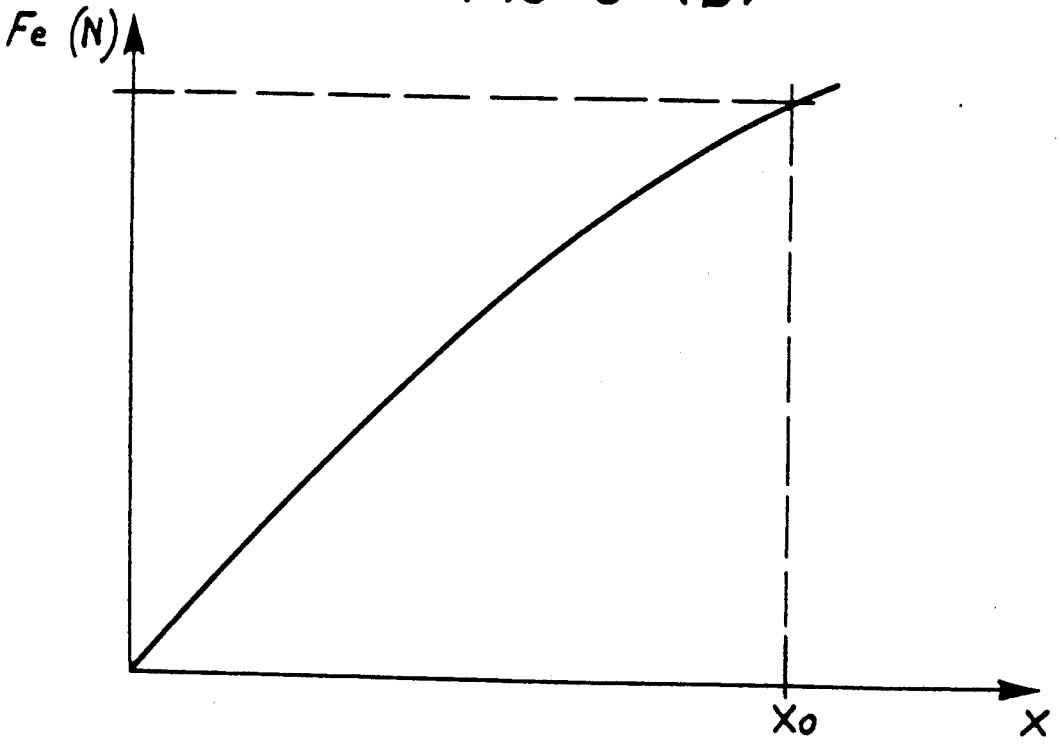

FIG. 5 shows the position of the spring 4 during the insertion of the half-connector 1 into the half-connector 2 in continuous outline and its initial position and the "dead point" position in chain line. In FIG. 5, the following values are shown: $\alpha$=the angle of the arms 6 (according to the definition given above), the indices "i" and "o" indicating its initial value and its dead-point value respectively.

Fo=the force applied by the operator to the half-connector 1,

Fo/2=the reaction force exerted by the restraints along the axis of the connector, Fe=the elastic deformation force, If, as stated, the frictional forces are ignored, then by simple mathematical steps:

$$Fe = Fo/2 \times 1/\sin\alpha$$

From a study of this formula it can be seen that, for a given force Fo, the resilient force Fe is greater the smaller the angle $\alpha$.

FIGS. 6*a* and 6*b* show qualitative changes in the angle $\alpha$ and in the elastic deformation force Fe during the connection travel up to the "dead point" indicated xo.

FIGS. 7*a* and 7*b* show a numerical example of the values of the angle $\alpha$ and of the elastic force Fe respectively on the ordinates as functions of the connection travel.

Figure 8:
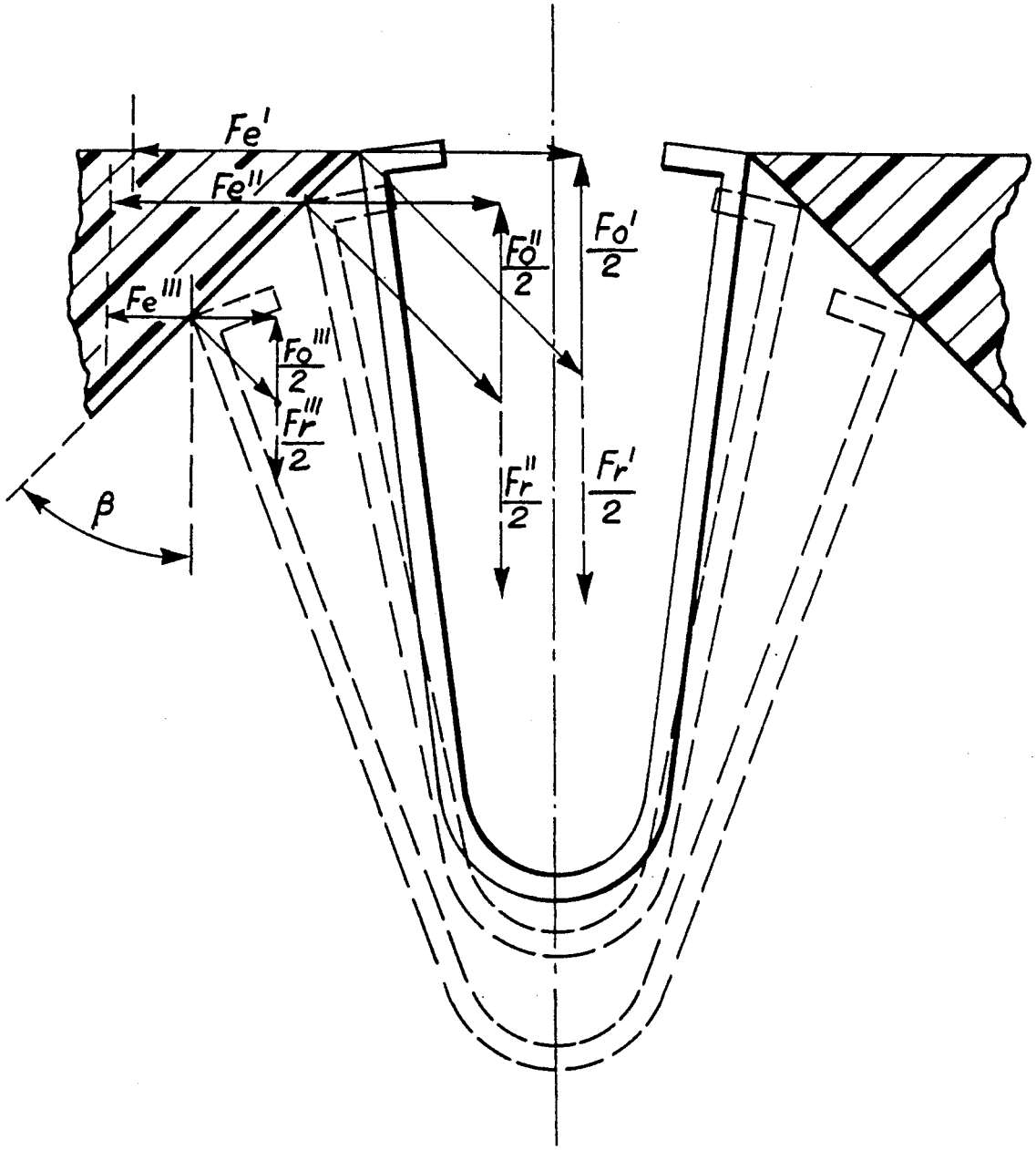
FIG. 8 shows some positions of the elastic-energy-storage device according to the invention during its connection travel.

FIG. 8 shows some positions of the spring 4 during its pulling travel, together with a graphical representation of the forces, the sliding friction of the arms 6 on the surfaces 7 of the walls 11 being ignored, as already stated. Thus, by simple steps:

$$Fe = F_r/2\mathrm{tg}\beta$$

$\beta$ being the angle between the inclined surface 7 and the longitudinal axis of the connector.

It can be seen that, for a given stored elastic force, the pulling force Fr is the greater the greater the angle $\beta$.

On the other hand, the travel achieved by the pull up to the complete restitution of the stored elastic energy (Fe=0) is naturally smaller the greater the angle $\beta$. The optimum value of $\beta$ must therefore reconcile two conflicting requirements, which are:

a) to maximise the pulling force Fr for a given elastic force Fe up to the point of complete connection;

b) to maximise the travel due to the pull in order to ensure the complete connection of the male-female contacts.

A good compromise is given when $\beta$ is between 40° and 50°.

Figure 9:
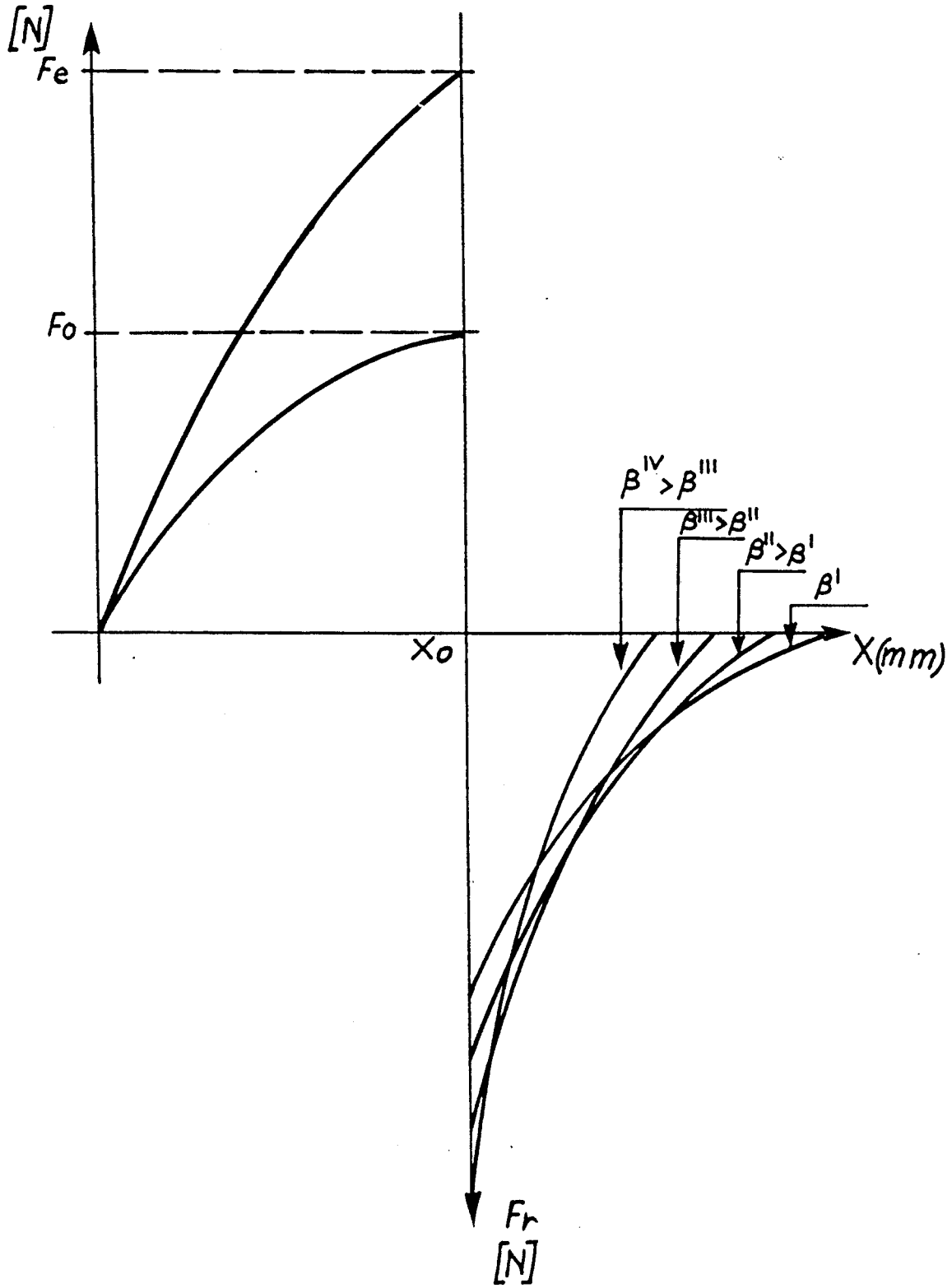
FIG. 9 shows the qualitative variations in the pulling force with variations in the angle of inclination of the bearing surface of the energy-absorption device according to the invention.

FIG. 9 shows the qualitative changes in the elastic force Fe and in the force Fo acting along the longitudinal axis of the connector as functions of the connection travel. The family of curves after the point xo ("dead point") has been crossed indicates how the pulling force Fr changes with variations in the angle of inclination $\beta$ of the inclined surfaces 7 of the walls 11.

Figure 10:
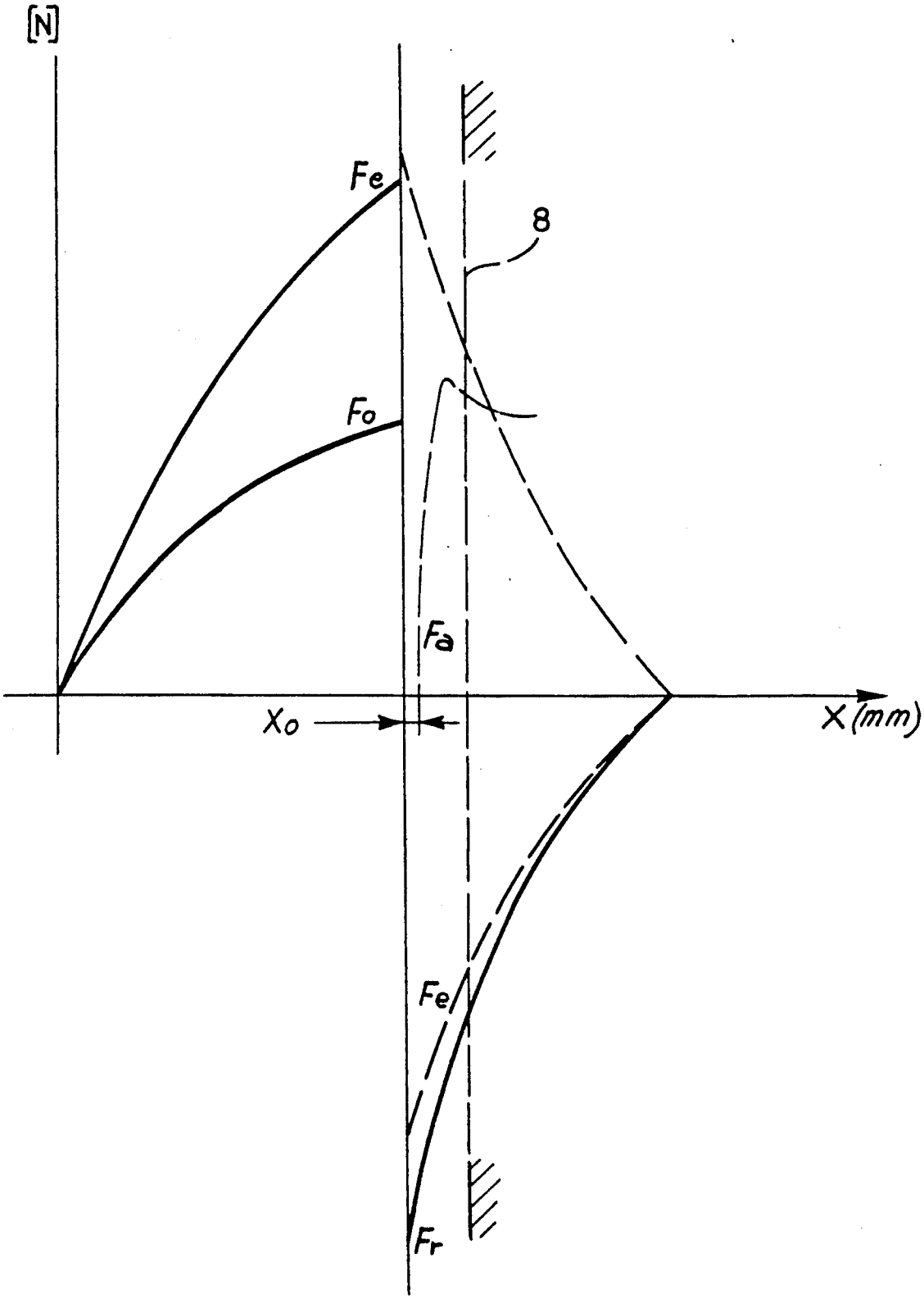
FIG. 10 shows the changes in the forces which come into play during the entire connection travel.

FIG. 10 shows the qualitative changes in the forces which come into play in the connector throughout the connection travel. As well as the changes in the forces Fe, Fo and Fr already described with reference to the preceding figures, the mechanical characteristic of the force Fa for the connection of the electrical terminals, also known as pins, is also shown.

It can be seen that the pulling force Fr is such as to exceed the force Fa for connecting the electrical terminals so that the equilibrium between the two forces takes place downstream of the positive engagement point shown by the broken line 8 in the drawing.

Moreover, it is clearly shown in FIG. 10 that electrical contact starts to occur downstream of the "dead point" so that electrical contact is not possible when the pins are only partially connected.

If friction is ignored, the energy stored during the first stage is equal to the energy returned during the second stage, that is, as a first approximation:

$$Fo \times l_2 = Fr \times l_1,$$

$$\left( \text{in exact terms} \int_0^{l_2} Fo \cdot dx = \int_0^{l_1} F_r \cdot dx \right)$$

where $\mathbf{1}_2$ and $\mathbf{1}_1$ are the longitudinal components of the arms of the spring 4 and of the inclined surfaces 7 respectively. From this formula it can be deduced that the pulling force Fr can be made greater than Fo in order to ensure the automatic connection of the two half connectors by changing the geometry of the energy-storage system, in this case for example, by increasing $\mathbf{1}_2$ relative to 11.

What is claimed is:

1. An electrical connector for multiway connections in an electrical system of a motor vehicle comprising:

a first half-connector carrying male or female terminals of a first ribbon of cables and a second half-connector carrying female or male terminals of a second ribbon of cables, one of said half-connectors including a resilient device which stores energy during a first stage in connecting said half-connectors and which can return the stored energy to enable automatic connection of the first and second half-connectors during a subsequent second stage in connection said half-connectors, said resilient device for restoring energy comprising a substantially U-shaped spring having a pair of diverging free ends in the unstressed state, securing means in the first half-connector engaging the spring and securing said spring in said first half-connector with said spring disposed symmetrically with respect to a longitudinal axis of the connector, said second half-connector having a pair of spaced apart walls with oppositely inclined surfaces which are each inclined at an angle $\beta$ to the longitudinal axis of the connector, said walls having spaced apart free corners where the walls are closest which cause elastic deformation of the U-shaped spring as the spring passes between the corners during connecting of said half-connectors until said free ends of said spring pass the spaced apart corners of said walls, whereby engagement of said free ends of said spring with said inclined surfaces allows said spring to be restored toward said unstressed state and to generate a force to complete inserting said first half-connector into said second half-connector.

2. A connector according to claim 1, wherein the angle $\beta$ is between 40° and 50°.

3. A connector according to claim 1, wherein a longitudinal component of the length of the arms of the U-shaped spring is greater than a longitudinal component of the length of the inclined surfaces.

4. A connector according to claim 1, wherein a longitudinal component of the length of the inclined surfaces is greater than or equal to a distance necessary to achieve electrical coupling so as to prevent partial electrical coupling.

5. A connector according to claim 1, wherein the walls with inclined surfaces are rigid.

6. A connector according to claim 1, wherein the walls with inclined surfaces are themselves resilient.

7. A connector according to claim 1, further comprising an engagement system for preventing accidental release of the two half-connectors.

* * * * *

UNITED STATES PATENT AND TRADEMARK OFFICE

CERTIFICATE OF CORRECTION

PATENT NO. : 5,035,642

DATED : July 30, 1991

INVENTOR(S) : Oreste VITTONE and Matteo PICCIRIELLO

It is certified that error appears in the above-identified patent and that said Letters Patent is hereby corrected as shown below:

ON THE TITLE PAGE

-- [30] Foreign Application Priority Data

May 3, 1989 [IT] Italy ..... 67318-A/89 --

Signed and Sealed this

Sixth Day of April, 1993

*Attest:*

STEPHEN G. KUNIN

*Attesting Officer*

*Acting Commissioner of Patents and Trademarks*